US007592109B2

(12) United States Patent
Wu et al.

(10) Patent No.: US 7,592,109 B2
(45) Date of Patent: Sep. 22, 2009

(54) THICK ELECTROPHOTOGRAPHIC IMAGING MEMBER UNDERCOAT LAYERS

(75) Inventors: Jin Wu, Webster, NY (US); John J. Wilbert, Macedon, NY (US); Daniel V. Levy, Rochester, NY (US); Liang-bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/393,135

(22) Filed: Feb. 26, 2009

(65) Prior Publication Data

US 2009/0162094 A1 Jun. 25, 2009

Related U.S. Application Data

(62) Division of application No. 11/211,756, filed on Aug. 26, 2005.

(51) Int. Cl.
*G03G 5/10* (2006.01)

(52) U.S. Cl. ..... 430/58.05; 399/111; 399/159

(58) Field of Classification Search ..... 430/58.05; 399/111, 159

See application file for complete search history.

(56) References Cited

U.S. PATENT DOCUMENTS

| | | | | |
|---|---|---|---|---|
| 4,265,990 | A | 5/1981 | Stolka et al. | |
| 4,444,954 | A | 4/1984 | Mels et al. | |
| 4,654,284 | A | 3/1987 | Yu et al. | |
| 4,921,769 | A | 5/1990 | Yuh et al. | |
| 5,725,985 | A | 3/1998 | Nealey et al. | |
| 5,958,638 | A | 9/1999 | Katayama et al. | |
| 6,017,666 | A | 1/2000 | Nealey et al. | |
| 6,132,912 | A | 10/2000 | Fuller et al. | |
| 6,287,737 | B1 | 9/2001 | Ong et al. | |
| 6,444,386 | B1 | 9/2002 | Liu et al. | |
| 6,593,417 | B1 | 7/2003 | Anderson et al. | |
| 2004/0105156 | A1 | 6/2004 | Kayanoki | |
| 2005/0090620 | A1 | 4/2005 | Grace et al. | |
| 2006/0009576 | A1 * | 1/2006 | Molaire | 524/839 |
| 2006/0106157 | A1 | 5/2006 | Sawant et al. | |
| 2008/0220350 | A1 * | 9/2008 | Wu et al. | 430/58.8 |

* cited by examiner

*Primary Examiner*—Hoa V Le
(74) *Attorney, Agent, or Firm*—Oliff & Berridge, PLC

(57) ABSTRACT

Binders containing metal oxide nanoparticles and a co-resin of acrylic polyol resin and blocked polyisocyanate resin, and electrophotographic imaging member undercoat layer containing the binders.

10 Claims, 1 Drawing Sheet

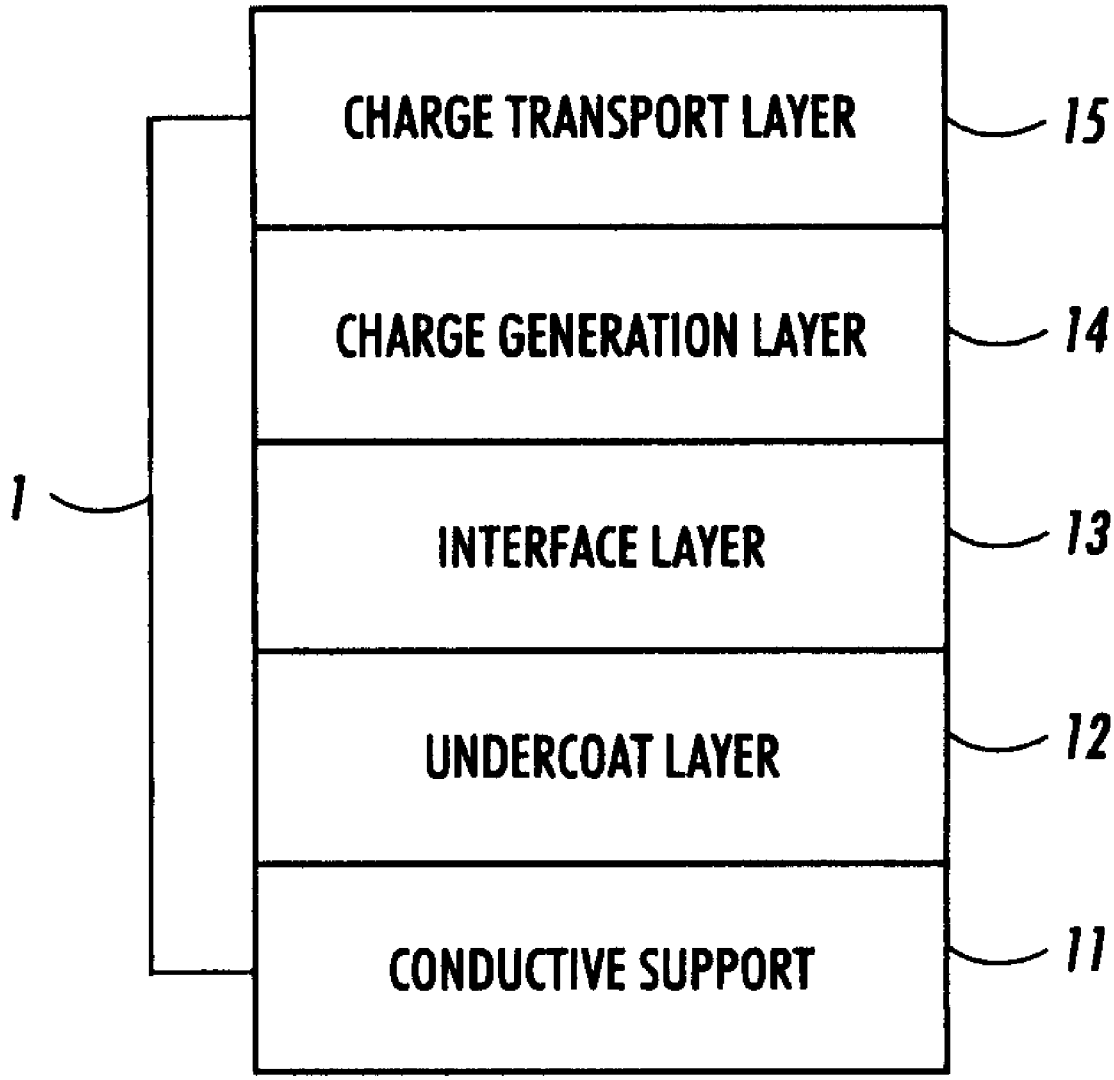
CHARGE TRANSPORT LAYER
15
CHARGE GENERATION LAYER
14
1
INTERFACE LAYER
13
UNDERCOAT LAYER
12
CONDUCTIVE SUPPORT
11

THICK ELECTROPHOTOGRAPHIC IMAGING MEMBER UNDERCOAT LAYERS

This is a Division of application Ser. No. 11/211,756 filed Aug. 26, 2005. The disclosure of the prior application is hereby incorporated by reference herein in its entirety.

TECHNICAL FIELD

This disclosure is generally directed to binders containing metal oxide nanoparticles, and electrographic imaging members containing the binders. More particularly, this disclosure is generally directed to binders containing metal oxide nanoparticles and a co-resin of acrylic polyol resin and blocked polyisocyanate resin, and electrographic imaging members containing the binders.

BACKGROUND

In xerography, or electrophotographic printing/copying, an electrophotographic imaging member is electrostatically charged. For optimal image production, the electrophotographic imaging member should be uniformly charged across its entire surface. The electrophotographic imaging member is then exposed to a light pattern of an input image to selectively discharge the surface of the electrophotographic imaging member in accordance with the image. The resulting pattern of charged and discharged areas on the electrophotographic imaging member forms an electrostatic charge pattern (i.e., a latent image) conforming to the input image. The latent image is developed by contacting it with finely divided electrostatically-attractable powder called toner. Toner is held on the image areas by electrostatic force. The toner image may then be transferred to a substrate or support member, and the image is then affixed to the substrate or support member by a fusing process to form a permanent image on the substrate or support member. After transfer, excess toner left on the electrophotographic imaging member is cleaned from its surface, and residual charge is erased from the electrophotographic imaging member.

Electrophotographic imaging members can be provided in a number of forms. For example, an electrophotographic imaging member can be a homogeneous layer of a single material, such as vitreous selenium, or it can be a composite layer containing an electrophotographic layer and another material. In addition, the electrophotographic imaging member can be layered.

Conventional layered electrophotographic imaging members generally have at least a flexible substrate support layer and two active layers. These active layers generally include a charge generation layer containing a light absorbing material, and a charge transport layer containing charge transport molecules. These layers can be in any order, and sometimes can be combined in a single or a mixed layer. The flexible substrate support layer can be formed of a conductive material. Alternatively, a conductive layer can be formed on top of a nonconductive flexible substrate support layer.

Conventional electrophotographic imaging members may be either a function-separation type photoreceptor, in which a layer containing a charge generation substance (charge generation layer) and a layer containing a charge transport substance (charge transport layer) are separately provided, or a monolayer type photoreceptor in which both the charge generation layer and the charge transport layer are contained in the same layer.

Conventional binders used in electrophotographic imaging members typically contain vinyl chloride. Examples of conventional binders are disclosed in U.S. Pat. No. 5,725,985, incorporated herein by reference in its entirety, and U.S. Pat. No. 6,017,666, incorporated herein by reference in its entirety. Additionally, electrophotographic imaging members may be non-halogenated polymeric binders, such as a non-halogenated copolymers of vinyl acetate and vinyl acid.

Conventional electrophotographic imaging members may have an undercoat layer interposed between the conductive support and the charge generation layer. Examples of conventional undercoat layers are disclosed in U.S. Pat. Nos. 4,265,990; 4,921,769; 5,958,638; 5,958,638; 6,132,912; 6,287,737; and 6,444,386; incorporated herein by reference in their entireties.

SUMMARY

Thick undercoat layers are desirable for electrophotographic imaging members because thick undercoat layers have longer life spans, are resistant to carbon fiber, and permit the use of cheaper substrates. However, due to insufficient electron conductivity in dry and cold environments, the residual potential ($V_r$) in C zone (10% humidity and 15° C.) is unacceptably high (>150V) when the undercoat is thicker than about 15 μm. Thus, there is a need for novel undercoat layers that improve the electrical properties and performance of electrophotographic imaging members. The disclosure describes novel binders that improve the electrical properties and performance of thick undercoat layers and electrophotographic imaging members containing thick undercoat layers.

In embodiments, an electrographic, such as electrostatographic or electrophotographic, imaging member binder contains metal oxide nanoparticles and a co-resin comprising an acrylic polyol resin and a blocked polyisocyanate resin. In embodiments, the acrylic polyol resin can be selected from JONCRYL™ 580, 500, 550, 551, series (commercially-available from Johnson Polymer). In embodiments, the a blocked polyisocyanate resin can be selected from DESMODUR™ BL 4265SN, 3475BA/SN, 3370 MPA, 3272 MPA, 3175A series (commercially-available from Bayer). In embodiments, the metal oxide nanoparticles can be $TiO_2$, a powder volume resistivity varying from about $10^4$ to about $10^{10}$ Ωcm at a 100 kg/cm$^2$ loading pressure, 50% humidity, and room temperature.

In embodiments, an electrophotographic imaging member binder contains metal oxide nanoparticles, a co-resin comprising an acrylic polyol resin and a blocked polyisocyanate resin, an optional catalyst and an optional light scattering particle.

In embodiments, an electrophotographic imaging member undercoat layer contains metal oxide nanoparticles and a co-resin comprising an acrylic polyol resin and a blocked polyisocyanate resin. In embodiments, the acrylic polyol resin can be selected from JONCRYL™ 580, 500, 550, 551, series (commercially-available from Johnson Polymer). In embodiments, the a blocked polyisocyanate resin can be selected from DESMODUR™ BL 4265SN, 3475BA/SN, 3370 MPA, 3272 MPA, 3175A series (commercially-available from Bayer). In embodiments, the metal oxide nanoparticles of the undercoat layer can be $TiO_2$, having a powder volume resistivity varying from about $10^4$ to about $10^{10}$ Ωcm at a 100 kg/cm$^2$ loading pressure, 50% humidity, and room temperature. In various embodiments, the undercoat layer optionally further contains a catalyst. In various embodiments, the undercoat layer optionally further contains an optional light scattering particle.

In embodiments, an electrophotographic imaging member contains a support layer, a charge generation layer, a charge transport layer, an undercoat layer, and a binder containing metal oxide nanoparticles and a co-resin comprising an acrylic polyol resin and a blocked polyisocyanate resin. In various embodiments, the undercoat layer contains metal oxide nanoparticles and a co-resin comprising an acrylic polyol resin and a blocked polyisocyanate resin.

In embodiments, an electrophotographic process cartridge contains an electrophotographic imaging member containing metal oxide nanoparticles and a co-resin comprising an acrylic polyol resin and a blocked polyisocyanate resin, and contains at least one of a developing unit and a cleaning unit. In various embodiments, the electrophotographic imaging member contains an under coat layer containing metal oxide nanoparticles and a co-resin comprising an acrylic polyol resin and a blocked polyisocyanate resin. In various embodiments, the undercoat layer has a thickness of from about 0.1 μm to about 30 μm, or from about 2 μm to about 25 μm, or from about 10 μm to about 20 μm.

In embodiments, an electrophotographic image forming apparatus contains an electrophotographic imaging member containing metal oxide nanoparticles and a co-resin comprising an acrylic polyol resin and a blocked polyisocyanate resin, and contains at least one charging unit, at least one exposing unit, at least one developing unit, a transfer unit, and a cleaning unit. In various embodiments, the electrophotographic imaging member contains an under coat layer containing metal oxide nanoparticles and a co-resin comprising an acrylic polyol resin and a blocked polyisocyanate resin. In various embodiments, the undercoat layer has a thickness of from about 0.1 μm to about 30 μm, or from about 2 μm to about 25 μm, or from about 10 μm to about 20 μm.

BRIEF DESCRIPTION OF THE DRAWINGS

The FIGURE is a block diagram outlining the elements of an electrophotographic imaging member.

DETAILED DESCRIPTION OF PREFERRED EMBODIMENTS

In embodiments, an electrophotographic imaging member binder contains metal oxide nanoparticles and a co-resin comprising an acrylic polyol resin and a blocked polyisocyanate resin.

As used herein, an acrylic polyol is a compound derived from hydroxy-functional acrylic monomers. Such compounds are, for example, the esters of acrylic or (meth)acrylic acid and a polyhydric alcohol. As used herein, a polyhydric alcohol is any alcohol that contains two or more hydroxyl groups per molecule. As used herein, the terms (meth)acrylate and (meth)acrylic acid refer to both methacrylate and acrylate, as well as methacrylic acid and acrylic acid, respectively. The acrylic polyol can be prepared by conventional methods, such as, by the slow addition of acrylic monomers to a solvent solution of a polymerization initiator, such as an azo or peroxy initiator.

Examples of suitable polyols include, but are not limited to, two or more hydroxyl groups and a straight or branched hydrocarbon chain include hydroxyl functionalized polybutadiene, polycarbonates having hydroxyl groups. Other suitable polyol examples may be selected from saturated and unsaturated straight and branched chain linear aliphatic; saturated and unsaturated cyclic aliphatics, including heterocyclic aliphatic; or mononuclear or polynuclear aromatics, including heterocyclic aromatics alcohols. Polyols with two or more hydroxyl groups include hindered alcohols with for example, from about 5 to about 30 carbon atoms, for example, neopentyl glycol, 2,2-diethyl propane-1,3-diol, 2,2-dibutyl propane-1,3-diol, 2-methyl-2-propyl propane-1,3-diol, 2-ethyl-2-butyl propane-1,3-diol, trimethylol ethane, trimethylol propane, ditrimethylol propane, tritrimethylol propane, tetratrimethylol propane, pentaerythritol, dipentaerythritol, tripentaerythritol, tetrapentaerythritol, and pentapentaerythritol, or mixtures thereof. Specific hindered alcohols are those with from about 5 to about 10 carbon atoms such as trimethylol propane, ditrimethylol propane, pentaerythritol, dipentaerythritol, and tripentaerythritol. Polyols also include carbohydrate molecules, such as monosaccharides including, for example, mannose, galactose, arabinose, xylose, ribose, apiose, rhamnose, psicose, fructose, sorbose, tagitose, ribulose, xylulose, and erythrulose. Oligosaccharides include, for example, maltose, kojibiose, nigerose, cellobiose, lactose, melibiose, gentiobiose, turanose, rutinose, trehalose, sucrose and raffinose. Polysaccharides include, for example, amylose, glycogen, cellulose, chitin, inulin, agarose, zylans, mannan and galactans. Although perhaps sugar alcohols may not be considered carbohydrates, the naturally occurring sugar alcohols are very closely related to carbohydrates. Examples of sugar alcohols are sorbitol, mannitol and galactitol.

Examples of suitable acrylic monomers include, but are not limited to, (meth)acrylates and (meth)acrylic acids and alkyl acrylates and (meth)acrylates such as methyl, ethyl, propyl, n-butyl, i-butyl, t-butyl, 2-ethylhexyl and lauryl acrylates and (meth)acrylates, and mixtures thereof. In embodiments, the acrylic monomers may be selected from methyl acrylates and (meth)acrylates; ethyl acrylates and (meth)acrylates; propyl and isopropyl acrylates and (meth)acrylates; butyl, isobutyl, and tertiary butyl acrylates and (meth)acrylates; n-pentyl and isopentyl acrylates and (meth)acrylates; n-hexyl and isohexyl acrylates and (meth)acrylates; n-heptyl and iso-heptyl acrylates and (meth)acrylates; octyl and iso-octyl acrylates and (meth)acrylates; isobornyl acrylates and (meth)acrylates; trimethyl cyclohexyl acrylates and (meth)acrylates; and mixtures thereof.

In embodiments, the acrylic polyols optionally can be used in combination with one or more vinyl derivatives. Examples of suitable vinyl derivates include, but are not limited to, styrene, vinyl toluene, vinyl phenol, vinyl alkyl/aryl ether, vinyl alcohol, vinyl chloride, vinyl fluoride, vinylidene chloride, vinylidene fluoride, ethylene, propylene, isobutylene, (meth)acrylic amide, acrylonitrile, vinyl acetate, butadiene, isopentadiene, clorobutadiene, and mixtures thereof.

In embodiments, the acrylic polyol can be selected from, for example, hydroxyl-terminated polyacrylates, hydroxy ethyl(meth)acrylate, hydroxy propyl(meth)acrylate, hydroxy butyl(meth)acrylate, and hydroxyethyl acrylate. In embodiments, acrylic polyols include can be selected from JONCRYL™ 580, 500, 550, 551, 942, 945, 1540 series (commercially-available from Johnson Polymer); CARBOSET™ 514H (commercially-available from Noveon Inc.); ACRYLOID™ B-66 (commercially-available from Rohm & Hass); PLACCEL™ FA and FM series (commercially-available from Daicel Chemical Industries, Ltd.); and mixtures thereof.

As used herein, a polyisocyanate is the reaction product of an isocyanate and a polyol, and includes at least two free isocyanate groups. Also as used herein, a blocked polyisocyanate is a polyisocyanate in which a portion of the isocyanate groups have been reversibly reacted with a blocking agent so that the resultant blocked isocyanate group is stable to active hydrogens at room temperature but reactive with active hydrogens at elevated temperatures, for example, at temperatures between 60° C. and 200° C. As used herein, a blocked polyisocyanate encompasses polyisocyanates reacted with one or more blocking agents, self-blocked polyisocyanate compounds (such as those containing a urethodione linkage), fully-blocked polyisocyanates, and partially-blocked polyisocyanates. Blocked polyisocyanates are preferred because they have a longer pot life over unblocked polyisocyanates.

Examples of suitable polyisocyanates include, but are not limited to, organic diisocyanates, such as aliphatic diisocyanates (including hexamethylene diisocyanate and trimethylhexamethylene diisocyanate); cyclic aliphatic diisocyanates (such as xylylene diisocyanate, isophorone diisocyanate, 3-isocyanatomethyl-3,5,5-trimethylcyclohexylisocyanate; 3-isocyanatomethyl-3,5,5-trimethylcyclohexylisocyanate; aliphatic diisocyanates such as 1,6-hexamethylenediisocyanate, 2,2,4-trimethyl-1,6-hexamethylenediisocyanate, and 1,2-ethylenediisocyanate); aromatic diisocyanates (such as tolylene diisocyanate, 4,4'-diphenylmethane diisocyanate, 4,4'-methylenediphenylenediisocyanate, 4,6-di-(trifluoromethyl)-1,3-benzene diisocyanate, 2,4-toluenediisocyanate, 2,6-toluene diisocyanate, o, m, and p-xylylene diisocyanate, 4,4'-diisocyanatodiphenylether, 3,3'-dichloro-4,4'-diisocyanatodiphenylmethane, 4,5'-diphenyldiisocyanate, 4,4'-diisocyanatodibenzyl, 3,3'-dimethoxy-4,4'-diisocyanatodiphenyl, 3,3'-dimethyl-4,4'-diisocyanatodiphenyl, 2,2'-dichloro-5,5'-dimethoxy-4,4'-diisocyanato diphenyl, 1,3-diisocyanatobenzene, 1,2-naphthylene diisocyanate, 4-chloro-1,2-naphthylene diisocyanate, 1,3-naphthylene diisocyanate, and 1,8-dinitro-2,7-naphthylene diisocyanate, and polymethylenepolyphenylisocyanate); addition products of these organic diisocyanates with a polyhydric alcohol, a low molecular weight polyester resin (for example, a polyester polyol) or water; and polymers formed between the organic diisocyanates described above (including isocyanurate type polyisocyanate compounds).

For example, the polyisocyanates may be selected from ethylene diisocyanates; toluene diisocyanates (TDI) (for example, those commercially-available from available Allied Chemical); trimethylene diisocyanates; hexamethylene diisocyanates; propylene diisocyanates; ethylidene diisocyanates; cyclopentylene diisocyanates; cyclohexylene diisocyanates; phenylene diisocyanates; polymethylene polyphenylene-isocyanates; xylylene diisocyanates; chlorophenylene diisocyanates; isophorone diisocyanates (for example, those commercially-available from VEBA); methylene diphenyl diisocyanate (MDI); tetramethylxylene diisocyanates; triisocyanate adducts of hexamethylene diisocyanate and water; trimethyl hexamethylene diisocyanates; aliphatic diisocyanates having from 12 to 40 carbon atoms in the aliphatic moiety (for example, DDI 1410, commercially-available from General Mills Chemicals, Inc.); biurets and isocyanurates thereof, and mixtures thereof.

Examples of suitable blocking agents include, but are not limited to, alcohols (such as methanol, ethanol, butanol, hexanol, cyclohexanol, and benzyl alcohol), oximes (such as acetoxime, ketoxime, and cyclohexanone oxime, formaldoxime, acetaldoxime, methyl ethyl ketone oxime, acetophenone oxime, benzophenone oxime, 2-butanone oxime, and diethyl glyoxime), lactams (such as ϵ-caprolactam, δ-valerolactam, and γ-butyrolactam), phenols, amines (such as diisopropylamine or dibutylamine), imines, imidazoles, dimethylpyrazoles, triazoles, amides, sulfurs, bisulfites, dimethyl malonate, diethyl malonate, dibutyl malonate, and mixtures thereof. In embodiments, the blocking agent can be selected from XP-7180, Crelan NI-2, and Crelan NW-5 (commercially-available from Bayer Polymers LLC). Additional examples of blocking agents are disclosed in U.S. Pat. No. 4,444,954, incorporated herein by reference in its entirety.

In embodiments, the blocked polyisocyanate can be selected from DESMODUR™ BL 4265SN, 3475BA/SN, 3370 MPA, 3272 MPA, 3175A series (commercially-available from Bayer); VESTAGON™ B1530 and BF1540 (commercially-available from Huels Corporation); Baygard™ EDW (commercially-available from Bayer Corp.); Hydrophobol™ XAN (commercially-available from Ciba-Geigy); and the self-blocked polyisocyanate CRELAN™ VPLS 2147 (commercially-available from Bayer Polymers LLC).

In embodiments, a ratio of the acrylic polyol resin to the blocked polyisocyanate resin in the co-resin, such that in embodiments the NCO/OH ratio is from about 1/3 to about 3/1, or from about 1/1.5 to about 1.5/1, or from about 1/1.1 to about 1.1/1.

In embodiments, the metal oxide nanoparticles may be selected from, for example, ZnO, $SnO_2$, $TiO_2$, $Al_2O_3$, $SiO_2$, $ZrO_2$, $In_2O_3$, $MoO_3$, and a complex oxide thereof. In various embodiments, the metal oxide nanoparticles have a powder volume resistivity varying from about $10^4$ to about $10^{10}$ Ωcm at a 100 kg/cm$^2$ loading pressure, 50% humidity, and room temperature. In various embodiments, the metal oxide nanoparticles are $TiO_2$. Examples of $TiO_2$ nanoparticles include STR-60N (no surface treatment and powder volume resisitivity of approximately $9\times10^5$ Ωcm) (available from Sakai Chemical Industry Co., Ltd.), FTL-100 (no surface treatment and powder volume resisitivity of approximately $3\times10^5$ Ωcm) (available from Ishihara Sangyo Laisha, Ltd.), STR-60 ($Al_2O_3$ coated and powder volume resisitivity of approximately $4\times10^6$ Ωcm) (available from Sakai Chemical Industry Co., Ltd.), TTO-55N (no surface treatment and powder volume resisitivity of approximately $5\times10^5$ Ωcm) (available from Ishihara Sangyo Laisha, Ltd.), TTO-55A ($Al_2O_3$ coated and powder volume resisitivity of approximately $4\times10^7$ Ωcm) (available from Ishihara Sangyo Laisha, Ltd.), MT-150W (sodium metaphosphated coated and powder volume resisitivity of approximately $4\times10^4$ Ωcm) (available from Tayca), and MT-150AW (no surface treatment and powder volume resisitivity of approximately $1\times10^5$ Ωcm) (available from Tayca). In various embodiments, a ratio of the metal oxide nanoparticles to the co-resin can be from about 20/80 to about 80/20 wt/wt, or from about 40/60 to about 65/35.

In embodiments, the electrophotographic imaging member binder may optionally contain a catalyst. In various embodiments, the catalyst can be dibutyltin dilaurate, zinc octoate and other metallic soaps. In various embodiments, the catalyst can be present in an amount of from about 0.001% to about 0.1%, or from about 0.005% to about 0.015% by weight of a total weight of the electrophotographic imaging member binder. 2,4-pentanedione can be used to extend the pot life of the dispersion when a tin catalyst has been utilized.

In various embodiments, the electrophotographic imaging member binder may optionally contain a light scattering particle. In various embodiments, the light scattering particle has a refractive index different from the binder and has a number average particle size greater than about 0.8 μm. Examples of the light scattering particle include, but are not limited to, inorganic materials such as amorphous silica, silicone ball and minerals. Typical minerals include, for example, metal oxides, silicates, carbonates, sulfates, iodites, hydroxides, chlorides, fluorides, phosphates, chromates, clay, sulfur and the like. In various embodiments, the light scattering particle is amorphous silica P-100, commercially available from Espirit Chemical Co. In various embodiments, the light scattering particle can be present in an amount of from about 0% to about 10%, or from about 2% to about 5% by weight of a total weight of the electrophotographic imaging member binder.

Electrophotographic Imaging Member

The FIGURE is a cross sectional view schematically showing an embodiment of an electrophotographic imaging member. The electrophotographic imaging member 1 shown in the FIGURE contains separate charge generation layer 14 and charge transport layer 15. In the embodiment illustrated in the FIGURE, an undercoat layer 12 and an optional interface layer 13 are included in the electrophotographic imaging member 1. In embodiments, the undercoat layer 12 is interposed between the charge generation layer 14 and the conductive support 11. In embodiments, the interface layer is interposed between the undercoat layer 12 and the charge generation layer 14. In embodiments, the undercoat layer is located between the conductive support and the charge generation layer, without any intervening layers. In various embodiments, additional layers, such as an interface layer or an adhesive layer, may be present and located between the undercoat layer and the charge generation layer, and/or between the conductive support and the undercoat layer.

In embodiments, the conductive support 11 may include, for example, a metal plate, a metal drum or a metal belt using a metal such as aluminum, copper, zinc, stainless steel, chromium, nickel, molybdenum, vanadium, indium, gold or a platinum, or an alloy thereof; and paper or a plastic film or belt coated, deposited or laminated with a conductive polymer, a conductive compound such as indium oxide, a metal such as aluminum, palladium or gold, or an alloy thereof. Further, surface treatment such as anodic oxidation coating, hot water oxidation, chemical treatment, coloring or diffused reflection treatment such as graining can also be applied to a surface of the support 11.

In embodiments, the undercoat layer 12 contains metal oxide nanoparticles and a co-resin comprising an acrylic polyol resin and a blocked polyisocyanate resin. In various embodiments, the acrylic polyol resin is selected from a group consisting of hydroxyl-terminated polyacrylates, hydroxy ethyl (meth)acrylate, hydroxy propyl(meth)acrylate, hydroxy butyl(meth)acrylate, hydroxyethyl acrylate and their copolymers with styrene, vinyl toluene, vinyl phenol, vinyl alkyl/aryl ether, vinyl alcohol, vinyl chloride, vinyl fluoride, vinylidene chloride, vinylidene fluoride, ethylene, propylene, isobutylene, (meth)acrylic amide, acrylonitrile, vinyl acetate, butadiene, isopentadiene, clorobutadiene, the like and mixtures thereof. In various embodiments, the blocked polyisocyanate resin is a polyisocyanate based from the group consisting of hexamethylene diisocyanate, isophorone diisocyanate, toluene diisocyanate, 4,4'-diphenylmethane diisocyanate, the like and mixtures thereof. In embodiments, a ratio of the acrylic polyol resin to the blocked polyisocyanate resin in the co-resin, such that in embodiments the NCO/OH ratio is from about 1/3 to about 3/1, or from about 1/1.5 to about 1.5/1, or from about 1/1.1 to about 1.1/1. In various embodiments, the metal oxide nanoparticles are $TiO_2$. For example, in various embodiments, the $TiO_2$ is MT-150W, commercially available from Tayca. In various embodiments, the metal oxide nanoparticles have a powder volume resistivity varying from about $10^4$ to about $10^{10}$ Ωcm at a 100 kg/cm$^2$ loading pressure, 50% humidity, and room temperature. In various embodiments, a ratio of the metal oxide nanoparticles to the co-resin is about 20/80 to about 80/20 wt/wt.

In embodiments, the undercoat layer 12 may also contain one or more conventional binders. Examples of conventional binders include, but are not limited to, polyamides, vinyl chlorides, vinyl acetates, phenols, polyurethanes, melamines, benzoguanamines, polyimides, polyethylenes, polypropylenes, polycarbonates, polystyrenes, acrylics, methacrylics, vinylidene chlorides, polyvinyl acetals, epoxys, silicones, vinyl chloride-vinyl acetate copolymers, polyvinyl alcohols, polyesters, polyvinyl butyrals, nitrocelluloses, ethyl celluloses, caseins, gelatins, polyglutamic acids, starches, starch acetates, amino starches, polyacrylic acids, polyacrylamides, zirconium chelate compounds, titanyl chelate compounds, titanyl alkoxide compounds, organic titanyl compounds, silane coupling agents, and combinations thereof.

In embodiments, the undercoat layer 12 may optionally contain a catalyst. In various embodiments, the catalyst can be dibutyltin dilaurate, zinc octoate and other metallic soaps. In various embodiments, the catalyst can be present in an amount of from about 0.001% to about 0.1%, or from about 0.005% to about 0.015% by weight of a total weight of the electrophotographic imaging member binder. 2,4-pentanedione can be used to extend the pot life of the dispersion when a tin catalyst has been utilized.

In embodiments, the undercoat layer 12 may contain an optional light scattering particle. In various embodiments, the light scattering particle has a refractive index different from the binder and has a number average particle size greater than about 0.8 μm. In various embodiments, the light scattering particle is amorphous silica P-100 commercially available from Espirit Chemical Co. In various embodiments, the light scattering particle is present in an amount of about 0% to about 10% by weight of a total weight of the electrophotographic imaging member binder.

In embodiments, the undercoat layer 12 may contain various colorants. In various embodiments, the undercoat layer may contain organic pigments and organic dyes, including, but not limited to, azo pigments, quinoline pigments, perylene pigments, indigo pigments, thioindigo pigments, bisbenzimidazole pigments, phthalocyanine pigments, quinacridone pigments, quinoline pigments, lake pigments, azo lake pigments, anthraquinone pigments, oxazine pigments, dioxazine pigments, triphenylmethane pigments, azulenium dyes, squalium dyes, pyrylium dyes, triallylmethane dyes, xanthene dyes, thiazine dyes, and cyanine dyes. In various embodiments, the undercoat layer 12 may include inorganic materials, such as amorphous silicon, amorphous selenium, tellurium, a selenium-tellurium alloy, cadmium sulfide, antimony sulfide, titanium oxide, tin oxide, zinc oxide, and zinc sulfide, and combinations thereof.

In embodiments, the undercoat layer 12 may be formed between the electroconductive support and the charge generation layer. The undercoat layer is effective for blocking leakage of charge from the electroconductive support to the charge generation layer and/or for improving the adhesion between the electroconductive support and the charge generation layer. In embodiments, one or more additional layers may exist between the undercoat layer 12 and the charge generation layer.

In embodiments, the undercoat layer 12 can be coated onto the conductive support 11 from a suitable solvent. Suitable solvents include, but are not limited to, xylene/1-butanol/methyl ethyl ketone, N,N-dimethyl formamide, N,N-dimethyl acetamide, dimethyl sulfoxide, tetrahydrofuran, dichloromethane, xylene, toluene, methanol, ethanol, 1-butanol, isobutanol, methyl ethyl ketone, methyl isobutyl ketone, methyl n-amyl ketone, 1-methoxy-2-propyl acetate, and mixtures thereof.

In embodiments, the undercoat layer 12 may be coated onto the conductive substrate 11 using various coating methods. Suitable coating methods include, but are not limited to, blade coating, wire bar coating, spray coating, dip coating, bead coating, air knife coating or curtain coating is employed.

In embodiments, the thickness of the undercoat layer 12 is from about 0.1 μm to 30 μm, or from about 2 μm to 25 μm, or from about 10 μm to 20 μm. In embodiments, electrophotographic imaging members contain undercoat layer s having a thickness of from about 0.1 μm to 30 μm, or from about 2 μm to 25 μm, or from about 10 μm to 20 μm.

In embodiments, the electrophotographic imaging member 1 may optionally include an interface layer 13. In various embodiments, the interface layer 13 may contain one or more conventional components. Examples of conventional components include, but are not limited to, polyesters, polyamides, poly(vinyl butyral), poly(vinyl alcohol), polyurethane and polyacrylonitrile. In various embodiments, the interface layer may also contain conductive and nonconductive particles, such as zinc oxide, titanium dioxide, silicon nitride, carbon black, and the like.

In embodiments, the interface layer 13 may be coated onto a substrate using various coating methods. Suitable coating methods include, but are not limited to, blade coating, wire bar coating, spray coating, dip coating, bead coating, air knife coating or curtain coating is employed. In embodiments, the thickness of the interface layer is from about 0.001 μm to about 5 μm. In various embodiments, the thickness of the interface layer is less than about 1.0 μm. In various embodiments, the thickness of the interface layer is about 0.5 μm.

In embodiments, the charge generation layer 14 can be formed by applying a coating solution containing the charge generation substance(s) and a binding resin, and further fine particles, an additive, and other components.

In embodiments, binding resins used in the charge generation layer 14 may include polyvinyl acetal resins, polyvinyl formal resins or a partially acetalized polyvinyl acetal resins in which butyral is partially modified with formal or acetoacetal, polyamide resins, polyester resins, modified ether-type polyester resins, polycarbonate resins, acrylic resins, polyvinyl chloride resins, polyvinylidene chlorides, polystyrene resins, polyvinyl acetate resins, vinyl chloride-vinyl acetate copolymers, silicone resins, phenol resins, phenoxy resins, melamine resins, benzoguanamine resins, urea resins, polyurethane resins, poly-N-vinylcarbazole resins, polyvinylanthracene resins and polyvinylpyrene resins. These can be used either alone or as a combination of two or more of them.

In embodiments, the solvents used in preparing the charge generation layer coating solution may include organic solvents such as methanol, ethanol, n-propanol, n-butanol, benzyl alcohol, methyl cellosolve, ethyl cellosolve, acetone, methyl ethyl ketone, cyclohexanone, chlorobenzene, methyl acetate, n-butyl acetate, dioxane, tetrahydrofuran, methylene chloride and chloroform, mixtures of two or more of thereof, and the like.

In embodiments, the charge generation layer 14 may include various charge generation substances, including, but not limited to, various organic pigments and organic dyes such as an azo pigment, a quinoline pigment, a perylene pigment, an indigo pigment, a thioindigo pigment, a bisbenzimidazole pigment, a phthalocyanine pigment, a quinacridone pigment, a quinoline pigment, a lake pigment, an azo lake pigment, an anthraquinone pigment, an oxazine pigment, a dioxazine pigment, a triphenylmethane pigment, an azulenium dye, a squalium dye, a pyrylium dye, a triallylmethane dye, a xanthene dye, a thiazine dye and cyanine dye; and inorganic materials such as amorphous silicon, amorphous selenium, tellurium, a selenium-tellurium alloy, cadmium sulfide, antimony sulfide, zinc oxide and zinc sulfide. The charge generation substances may be used either alone or as a combination of two or more of them. In embodiments, the ratio of the charge generation substance to the binding resin is within the range of 5:1 to 1:2 by volume.

In embodiments, the charge generation layer 14 is formed by various forming methods, including but not limited to, dip coating, roll coating, spray coating, rotary atomizers, and the like. In various embodiments, the charge generation layer 14 is formed by the vacuum deposition of the charge generation substance(s), or by the application of a coating solution in which the charge generation substance is dispersed in an organic solvent containing a binding resin. In embodiments, the deposited coating may be effected by various drying methods, including, but not limited to, oven drying, infra-red radiation drying, air drying and the like.

In embodiments, a stabilizer such as an antioxidant or an inactivating agent can be added to the charge generation layer 14. The antioxidants include, for example, antioxidants such as phenolic, sulfur, phosphorus and amine compounds. The inactivating agents include bis(dithiobenzyl)nickel and nickel di-n-butylthiocarbamate. The charge transport layer 14 may further contain an additive such as a plasticizer, a surface modifier, and an agent for preventing deterioration by light.

In embodiments, the charge transport layer 15 can be formed by applying a coating solution containing the charge transport substance(s) and a binding resin, and further fine particles, an additive, and other components.

In embodiments, binding resins used in the charge transport layer 15 are high molecular weight polymers that can form an electrical insulating film. Examples of these binding resins include, but are not limited to, polyvinyl acetal resins, polyamide resins, cellulose resins, phenol resins, polycarbonates, polyesters, methacrylic resins, acrylic resins, polyvinyl chlorides, polyvinylidene chlorides, polystyrenes, polyvinyl acetates, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly(N-vinylcarbazoles), polyvinyl butyrals, polyvinyl formals, polysulfones, caseins, gelatins, polyvinyl alcohols, phenol resins, polyamides, carboxymethyl celluloses, vinylidene chloride-based polymer latexes, and polyurethanes.

In embodiments, the charge transport layer 15 may include various activating compounds that, as an additive dispersed in electrically inactive polymeric materials, makes these materials electrically active. These compounds may be added to polymeric materials which are incapable of supporting the injection of photogenerated holes from the charge generation material and incapable of allowing the transport of these holes there through. This will convert the electrically inactive polymeric material to a material capable of supporting the injection of photogenerated holes from the charge generation material and capable of allowing the transport of these holes through the active layer in order to discharge the surface charge on the active layer. In embodiments, the charge transport layer 15 is from about 25 percent to about 75 percent by weight of at least one charge transporting aromatic amine compound, and about 75 percent to about 25 percent by weight of a polymeric film forming resin in which the aromatic amine is soluble.

In embodiments, low molecular weight charge transport substances may include, but are not limited to, pyrenes, carbazoles, hydrazones, oxazoles, oxadiazoles, pyrazolines, arylamines, arylmethanes, benzidines, thiazoles, stilbenes, and butadiene compounds. Further, high molecular weight charge transport substances may include, but are not limited to, poly-N-vinylcarbazoles, poly-N-vinylcarbazole halides, polyvinyl pyrenes, polyvinylanthracenes, polyvinylacridines, pyreneformaldehyde resins, ethylcarbazole-formaldehyde resins, triphenylmethane polymers, and polysilanes.

In embodiments, the charge transport layer 15 may contain an additive such as a plasticizer, a surface modifier, an antioxidant or an agent for preventing deterioration by light.

In embodiments, the charge transport layer 15 may be mixed and applied to a coated or uncoated substrate by various methods, including, but not limited to, spraying, dip coating, roll coating, wire wound rod coating, and the like. In embodiments, the charge transport layer 15 may be dried by various drying method, including, but not limited to, oven drying, infra-red radiation drying, air drying and the like.

In embodiments, an overcoat layer may be applied to improve resistance to abrasion. The overcoat layer may contain a resin, a silicon compound and metal oxide nanoparticles. The overcoat layer may further contain a lubricant or fine particles of a silicone oil or a fluorine material, which can also improve lubricity and strength. In embodiments, the thickness of the overcoat layer is from 0.1 to 10 μm, from 0.5 to 7 μm, or from 1.5 to 3.5 μm.

In embodiments, an anti-curl back coating may be applied to provide flatness and/or abrasion resistance where a web configuration photoreceptor is fabricated. An example of an anti-curl backing layer is described in U.S. Pat. No. 4,654,284, incorporated herein by reference in its entirety.

Image Forming Apparatus and Process Cartridge

In embodiments, an image forming apparatus contains a non-contact charging unit (e.g., a corotron charger) or a contact charging unit, an exposure unit, a developing unit, a transfer unit and a cleaning unit are arranged along the rotational direction of an electrophotographic imaging member. In embodiments, the image forming apparatus is equipped with an image fixing device, and a medium to which a toner image is to be transferred is conveyed to the image fixing device through the transfer device.

In embodiments, the contact charging unit has a roller-shaped contact charging member. The contact charging unit is arranged so that it comes into contact with a surface of the electrophotographic imaging member, and a voltage is applied, thereby being able to give a specified potential to the surface of the electrophotographic imaging member. As a material for such a contact charging member, there can be used a metal such as aluminum, iron or copper, a conductive polymer material such as a polyacetylene, a polypyrrole or a polythiophene, or a dispersion of fine particles of carbon black, copper iodide, silver iodide, zinc sulfide, silicon carbide, a metal oxide or the like in an elastomer material such as polyurethane rubber, silicone rubber, epichlorohydrin rubber, ethylene-propylene rubber, acrylic rubber, fluororubber, styrene-butadiene rubber or butadiene rubber. Examples of the metal oxides include ZnO, $SnO_2$, $TiO_2$, $In_2O_3$, $MoO_3$ and a complex oxide thereof. Further, a perchlorate may be added to the elastomer material to impart conductivity.

In embodiments, a covering layer can also be provided on a surface of the contact charging unit. Materials for forming this covering layer may include N-alkoxymethylated nylon, a cellulose resin, a vinylpyridine resin, a phenol resin, a polyurethane, polyvinyl butyral and melamine, and these may be used either alone or as a combination of two or more of them. Furthermore, an emulsion resin material such as an acrylic resin emulsion, a polyester resin emulsion or a polyurethane, particularly an emulsion resin synthesized by soap-free emulsion polymerization can also be used. In order to further adjust resistivity, conductive agent particles may be dispersed in these resins, and in order to prevent deterioration, an antioxidant can also be added thereto. Further, in order to improve film forming properties in forming the covering layer, a leveling agent or a surfactant can also be added to the emulsion resin.

In embodiments, the resistance of the contact charging unit is from $10^0$ to $10^{14}$ Ωcm, or from $10^2$ to $10^{12}$ Ωcm. When a voltage is applied to this contact charging unit, either a DC voltage or an AC voltage can be used as the applied voltage. Further, a superimposed voltage of a DC voltage and an AC voltage can also be used. Such a contact charging unit may be in the shape of a blade, a belt, a brush or the like.

In embodiments, the exposure unit can be an optical device which can perform desired image wise exposure to a surface of the electrophotographic imaging member with a light source such as a semiconductor laser, an LED (light emitting diode) or a liquid crystal shutter. In various embodiments, the use of the exposure unit makes it possible to perform exposure to noninterference light.

In embodiments, the developing unit can be a known or later used developing unit using a normal or reversal developing agent of a one-component system, a two-component system or the like. There is no particular limitation on the shape of a toner used, and for example, an irregularly shaped toner obtained by pulverization or a spherical toner obtained chemical polymerization is suitably used.

In embodiments, the transfer unit can be a contact type transfer charging device using a belt, a roller, a film, a rubber blade or the like, or a scorotron transfer charger or a corotron transfer charger utilizing corona discharge.

In embodiments, the cleaning unit can be a device for removing a remaining toner adhered to the surface of the electrophotographic imaging member after a transfer step, and the cleaned electrophotographic imaging member is repeatedly subjected to the above-mentioned image formation process. The cleaning unit can be a cleaning blade, a cleaning brush, a cleaning roll or the like. In embodiments, a cleaning blade is used. Materials for the cleaning blade may include urethane rubber, neoprene rubber and silicone rubber.

In embodiments, an intermediate transfer belt is supported with a driving roll, a backup roll and a tension roll at a specified tension, and rotatable by the rotation of these rolls without the occurrence of deflection. Further, a secondary transfer roll can be arranged so that it is brought into abutting contact with the backup roll through the intermediate transfer belt. The intermediate transfer belt which has passed between the backup roll and the secondary transfer roll can be cleaned up by a cleaning blade, and then repeatedly subjected to the subsequent image formation process.

The disclosure should not be construed as being limited to the above-mentioned embodiments. For example, in embodiments, the image forming apparatus can be equipped with a process cartridge comprising the electrophotographic imaging member(s) and charging device(s). The use of such a process cartridge allows maintenance to be performed more simply and easily.

Furthermore, in embodiments, a toner image formed on the surface of the electrophotographic imaging member can be directly transferred to the medium. In various other embodiments, the image forming apparatus may be provided with an intermediate transfer body. This makes it possible to transfer the toner image from the intermediate transfer body to the medium after the toner image on the surface of the electrophotographic imaging member has been transferred to the intermediate transfer body. In embodiments, the intermediate transfer body can have a structure in which an elastic layer containing a rubber, an elastomer, a resin or the like and at least one covering layer are laminated on a conductive support.

In addition, in embodiments, the disclosed image forming apparatus may be further equipped with a static eliminator such as an erase light irradiation device. This prevents the incorporation of the residual potential of the electrophotographic imaging member into the subsequent cycle, when the electrophotographic imaging member is repeatedly used.

Examples are set forth below and are illustrative embodiments. It will be apparent to one skilled in the art that the embodiments can be practiced with many types of compositions and can have many different uses in accordance with the disclosure above and as pointed out hereinafter.

EXAMPLES

Examples 1 and 2

In Examples 1 and 2, undercoat layers were prepared as follows: a titanium oxide/acrylic polyol resin/blocked polyisocyanate resin dispersion was prepared by ball milling 10 grams of titanium dioxide (MT-150W, Tayca Company), 2.6 grams of the acrylic polyol resin (JONCRYL™ 580, a solid styrene acrylic polymer with Tg~50° C., HO number~160, and molecular weight~15,000, from Johnson Polymer) and 3.7 grams of the blocked polyisocyanate resin (DESMODUR™ BL3175A, a blocked aliphatic polyisocyanate based on hexamethylene diisocyanate, from Bayer) in 20 grams of methyl ethyl ketone for 5 days. The resulting titanium dioxide dispersion was filtered with a 20 micrometer pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/JONCRYL™/DESMODUR™ dispersion. A catalyst (dibutyltin dilaurate, from Aldrich) was added into the dispersion in an amount of 0.005% by weight of the total weight of the binder to obtain the coating dispersion. Then an aluminum drum, cleaned with detergent and rinsed with deionized water, was coated with the above generated coating dispersion, and subsequently, dried at 150° C. for 30 minutes, which resulted in an undercoat layer deposited on the aluminum and comprised of $TiO_2$/JONCRYL™/DESMODUR™ with a weight ratio of about 65/17/18 and a thickness of 11 microns (Example 1) and 19 microns (Example 2).

An HOGaPc photogeneration layer dispersion was prepared as follows: 3 grams of HOGaPc Type V pigment was mixed with about 2 grams of VMCH (Dow Chemical) and 45 grams of n-butyl acetate. The mixture was milled in an Attritor mill with about 200 grams of 1 mm Hi-Bea borosilicate glass beads for about 3 hours. The dispersion was filtered through a 20-μm nylon cloth filter, and the solid content of the dispersion was diluted to about 5 weight percent with n-butyl acetate. The HOGaPc photogeneration layer dispersion was applied on top of the undercoat layer. The thickness of the photogeneration layer was approximately 0.2 μm. Subsequently, a 28 μm charge transport layer was coated on top of the photogeneration layer from a solution prepared from N,N'-diphenyl-N,N-bis(3-methylphenyl)-1,1'-biphenyl-4,4'-diamine (5 grams) and a film forming polymer binder PCZ-400 [poly(4,4'-dihydroxy-diphenyl-1-1-cyclohexane, $M_w$=40,000)] available from Mitsubishi Gas Chemical Company, Ltd. (7.5 grams) dissolved in a solvent mixture of 20 grams of tetrahydrofuran (THF) and 6.7 grams of toluene. The charge transport layer was dried at about 120° C. for about 40 minutes.

Comparative Example 1

In Comparative Example 1, a photoreceptor was formed in the same manner as for Examples 1 and 2. However, in Comparative Example 1, the undercoat layer was prepared as follows: a titanium oxide/phenolic resin dispersion was prepared by ball milling 15 grams of titanium dioxide (MT-150W, Tayca Company) and 16.1 grams of the phenolic resin (VARCUM™ 29159, OxyChem Company, $M_w$ of about 3,600, viscosity of about 200 cps) in 7.5 grams of 1-butanol, and 7.5 grams of xylene with 120 grams of 1 millimeter diameter sized $ZrO_2$ beads for 5 days. The resulting titanium dioxide dispersion was filtered with a 20 micrometer pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/VARCUM™ dispersion. 0.5 grams of methyl ethyl ketone was added into the dispersion to obtain the coating dispersion. Then an aluminum drum, cleaned with detergent and rinsed with deionized water, was coated with the above generated coating dispersion, and subsequently, dried at 160° C. for 15 minutes, which resulted in an undercoat layer deposited on the aluminum and comprised of $TiO_2$/VARCUM™ with a weight ratio of about 65/35 and a thickness of 17 microns. The undercoat layer in Comparative Example 1 did not include the acrylic polyol/blocked polyisocyanate resin, and did not include the components ratio of Examples 1 and 2.

The above prepared photoreceptor devices were tested in a scanner set to obtain photo induced discharge curves, sequenced at one charge-erase cycle followed by one charge-expose-erase cycle, wherein the light intensity was incrementally increased with cycling to produce a series of photo induced discharge characteristic curves (PIDC) from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters; the exposure light source was a 780-nanometer light emitting diode. The aluminum drum was rotated at a speed of about 61 revolutions per minute to produce a surface speed of about 122 millimeters per second. The xerographic simulation was completed in an environmentally controlled light tight chamber at ambient conditions (about 50 percent relative humidity and about 22° C.).

The photoreceptors of Examples 1 and 2 exhibited significantly lower B zone (50% humidity and 22° C.) and C zone (10% humidity and 15° C.) $V_r$ values as compared to the photoreceptors of Comparative Example 1. Specifically, the photoreceptor of Comparative Example 1 exhibited a C zone $V_r$ of about 150 V, while the photoreceptor of Example 1 exhibited a C zone $V_r$ of about 50 V and the photoreceptor of Example 2 exhibited a C zone $V_r$ of about 61 V.

Furthermore, the charge electric properties and the erase electric properties of the photoreceptor of Examples 1 and 2 did not significantly vary from the charge electric properties and the erase electric properties of the photoreceptor of Comparative Example 1. Accordingly, the electric properties of the photoreceptor of Examples 1 and 2 are not adversely affected by the presence of the undercoat layer containing metal oxide nanoparticles and a co-resin of an acrylic polyol resin and a blocked polyisocyanate resin.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. An electrophotographic imaging member, comprising:

a support layer, an undercoat layer comprising a binder, the binder comprising metal oxide nanoparticles and a co-resin comprising an acrylic polyol resin and a blocked polyisocyanate resin, a charge generation layer, and a charge transport layer.

2. The electrophotographic imaging member of claim 1, wherein the undercoat layer has a thickness of from about 0.1 μm to about 30 μm.

3. The electrophotographic imaging member of claim 1, wherein the undercoat layer has a thickness of from about 2 μm to about 25 μm.

4. The electrophotographic imaging member of claim 1, wherein the undercoat layer has a thickness of from about 10 μm to about 20 μm.

5. The electrophotographic imaging member of claim 1, wherein a ratio of the metal oxide nanoparticles to the co-resin in the undercoat layer is about 40/60 to about 65/35 wt/wt.

6. The electrophotographic imaging member of claim 1, wherein a NCO/OH ratio in the co-resin of NCO groups in the blocked polyisocyanate resin to OH groups in the acrylic polyol resin is from about 1/2 to about 2/1.

7. A process cartridge comprising the electrophotographic imaging member of claim 1 and at least one of a developing unit and a cleaning unit.

8. The process cartridge of claim 7, wherein the undercoat layer has a thickness of from about 0.1 μm to about 30 μm, and the metal oxide nanoparticles have a powder volume resistivity varying from about $10^4$ to about $10^{10}$ Ωcm at a 100 kg/cm$^2$ loading pressure, 50% humidity, and room temperature.

9. An image forming apparatus comprising at least one charging unit, at least one exposing unit, at least one developing unit, a transfer unit, a cleaning unit, and the electrophotographic imaging member of claim 1.

10. The image forming apparatus of claim 9, wherein the undercoat layer has a thickness of from about 0.1 μm to about 30 μm, and the metal oxide nanoparticles have a powder volume resistivity varying from about $10^4$ to about $10^{10}$ Ωcm at a 100 kg/cm$^2$ loading pressure, 50% humidity, and room temperature.

* * * * *